US010948856B2

(12) United States Patent
Matsuo

(10) Patent No.: US 10,948,856 B2
(45) Date of Patent: Mar. 16, 2021

(54) IMAGE FORMING APPARATUS, IMAGE FORMING SYSTEM, IMAGE FORMING METHOD, AND IMAGE FORMING APPARATUS-SPECIFIC PROGRAM

(71) Applicant: KONICA MINOLTA, INC., Tokyo (JP)

(72) Inventor: Masahiro Matsuo, Kokubunji (JP)

(73) Assignee: Konica Minolta, Inc., Tokyo (JP)

( * ) Notice: Subject to any disclaimer, the term of this patent is extended or adjusted under 35 U.S.C. 154(b) by 317 days.

(21) Appl. No.: 16/001,255

(22) Filed: Jun. 6, 2018

(65) Prior Publication Data

US 2018/0373185 A1 Dec. 27, 2018

(30) Foreign Application Priority Data

Jun. 27, 2017 (JP) ..... JP2017-125426

(51) Int. Cl.
*G03G 15/20* (2006.01)
*G03G 15/00* (2006.01)

(52) U.S. Cl.
CPC ..... *G03G 15/2039* (2013.01); *G03G 15/2017* (2013.01); *G03G 15/6517* (2013.01)

(58) Field of Classification Search
CPC ..... G03G 15/2039; G03G 15/2017; G03G 15/6517
See application file for complete search history.

(56) References Cited

U.S. PATENT DOCUMENTS 3,948,170 A * 4/1976 Ericsson ..... B65H 9/06 101/124
10,112,314 B2 * 10/2018 Takatsu ..... B26D 5/007
2008/0084443 A1 * 4/2008 Yasue ..... G06K 15/16 347/16
2013/0256988 A1 * 10/2013 Takahashi ..... B41J 13/0009 271/270
2014/0035985 A1 * 2/2014 Arakane ..... B41J 2/01 347/16
2014/0126006 A1 * 5/2014 Yoshida ..... G06F 3/1256 358/1.9

(Continued)

FOREIGN PATENT DOCUMENTS

JP 2017-062363 A 3/2017

*Primary Examiner* — David H Banh
(74) *Attorney, Agent, or Firm* — Buchanan Ingersoll & Rooney PC

(57) ABSTRACT

An image forming apparatus connectable to a post-processing apparatus via a carriage path for carrying continuous paper includes: a hardware processor that accepts a stop position of the continuous paper on the carriage path; a carrier that carries the continuous paper along the carriage path; an image former that forms an image on the continuous paper; a fuser that heats and presses the continuous paper passing through a nip portion formed by pressing bodies of revolution against each other to fix the image; and the hardware processor that switches between first control that, after the last image among the images formed on the continuous paper passes the fuser, stops carriage of the continuous paper and then separates the pressed bodies of revolution, and second control that separates the pressed bodies of revolution and then stops the carriage of the continuous paper, on the basis of the accepted stop position.

19 Claims, 10 Drawing Sheets

(56) References Cited

U.S. PATENT DOCUMENTS

| | | | | |
|---|---|---|---|---|
| 2015/0166295 | A1* | 6/2015 | Kanemaru | B65H 9/04 270/58.08 |
| 2015/0177672 | A1* | 6/2015 | Jung | G03G 15/757 399/167 |
| 2015/0183610 | A1* | 7/2015 | Matsuki | B65H 9/10 270/58.08 |
| 2015/0241833 | A1* | 8/2015 | Soda | B41J 11/0005 399/406 |
| 2015/0258825 | A1* | 9/2015 | Ogimura | B41J 23/00 347/37 |
| 2015/0338808 | A1* | 11/2015 | Ishihara | G03G 15/2028 399/401 |
| 2016/0114993 | A1* | 4/2016 | Nakagaki | B65H 5/26 271/9.05 |
| 2016/0170362 | A1* | 6/2016 | Ye | B65H 5/06 271/10.13 |
| 2016/0191733 | A1* | 6/2016 | Konishi | H04N 1/00925 358/1.12 |
| 2017/0060048 | A1* | 3/2017 | Sasami | G03G 15/2028 |
| 2017/0072718 | A1* | 3/2017 | Watanabe | B41J 3/4075 |
| 2017/0227905 | A1* | 8/2017 | Hiroi | G03G 21/14 |
| 2017/0259447 | A1* | 9/2017 | Takatsu | B26F 1/02 |
| 2018/0057296 | A1* | 3/2018 | Shirasaki | B41J 13/10 |

* cited by examiner

| PROCESS LINEAR SPEED | STOP SECTION 1 | STOP SECTION 2 |
|---|---|---|
| HIGH SPEED | 0.00m ≤ X < 0.97m | 0.97m ≤ X ≤ 2.28m |
| MIDDLE SPEED | 0.00m ≤ X < 0.70m | 0.70m ≤ X ≤ 2.01m |
| LOW SPEED | 0.00m ≤ X < 0.51m | 0.51m ≤ X ≤ 1.82m |

IMAGE FORMING APPARATUS, IMAGE FORMING SYSTEM, IMAGE FORMING METHOD, AND IMAGE FORMING APPARATUS-SPECIFIC PROGRAM

The entire disclosure of Japanese patent Application No. 2017-125426, filed on Jun. 27, 2017, is incorporated herein by reference in its entirety.

BACKGROUND

Technological Field

The present invention relates to an image forming apparatus, an image forming system, an image forming method, and an image forming apparatus-specific program.

Description of the Related Art

An electrophotographic image forming apparatus has conventionally been known which forms an image on paper by transferring and fixing a toner image to the paper. When the paper passes through a nip portion that is formed in a fuser by pressing heated bodies of revolution against each other, the toner image is heated and pressed to be fixed to the paper.

If such an image forming apparatus forms an image on continuous paper, a post-processing apparatus such as a take-up apparatus is connected to the image forming apparatus. Post-processing such as take-up of the continuous paper is performed by the post-processing apparatus. There are user requests to change a stop position of the continuous paper that is carried from the image forming apparatus depending on, for example, the type of post-processing apparatus upon post-processing. This is because a desired position to stop the continuous paper may vary according to the post-processing apparatus, depending on the purpose of checking a sample image on the continuous paper, removing the continuous paper, or the like.

Depending on the stop position of the continuous paper, there may arise the following problems: for example, the continuous paper deforms due to the heat of the fuser, which leads to a reduction in take-up quality; and, depending on the configuration of the post-processing apparatus, there may arise a case where the continuous paper stops at a position where it is not possible to check a sample image and a case where a distance required to stop is long so that the amount of waste paper (paper to be discarded) is increased more than necessary. Furthermore, depending on the continuous paper stop operation, there may arise the following problems: for example, when the bodies of revolution of the fuser are cooled after an image is formed, lack of cooling may cause the continuous paper that stops at a position near the bodies of revolution to deform, or over-cooling may cause warm-up time for a subsequent job to increase; and the carriage of the continuous paper is stopped after a wait for the separation of the bodies of revolution of the fuser and therefore it may become impossible to stop the continuous paper that has just been ejected from the image forming apparatus.

As a prior art that makes it possible to prevent continuous paper from deforming due to the heat of the fuser and check an image on the continuous paper, there is one described in JP 2017-62363 A. In other words, after bodies of revolution of a fuser fix a toner image to continuous paper, the bodies of revolution are cooled by a fan blowing air to the bodies of revolution and by dissipating heat to the continuous paper with the carriage of the continuous paper by the bodies of revolution. At this point in time, the cooling of the bodies of revolution is completed before the last image that was last formed is carried to a position where it is possible to check the image. Consequently, it is possible to check the last image without deforming the continuous paper due to the heat of the bodies of revolution.

However, when the image forming apparatus is connected to various post-processing apparatuses, desired stop positions are different depending on the post-processing apparatuses, which is a problem that cannot be handled by the technology described in JP 2017-62363 A. Moreover, there is a problem that it is not possible to reduce the amount of waste paper according to the stop position and ensure take-up quality.

SUMMARY

The present invention has been made to solve such problems. In other words, an object thereof is to provide an image forming apparatus, an image forming system, an image forming method, and an image forming apparatus-specific program that can stop continuous paper at a stop position corresponding to a post-processing apparatus, and achieve a reduction in the amount of waste paper according to the stop position and ensuring of take-up quality.

To achieve the abovementioned object, according to an aspect of the present invention, there is provided an image forming apparatus connectable to a post-processing apparatus via a carriage path for carrying continuous paper, and the image forming apparatus reflecting one aspect of the present invention comprises: a hardware processor that accepts a stop position of the continuous paper on the carriage path; a carrier that carries the continuous paper along the carriage path; an image former that forms an image on the continuous paper to be carried; a fuser that heats and presses the continuous paper passing through a nip portion formed by pressing bodies of revolution against each other to fix the image formed on the continuous paper; and a controller that switches between first control that, after the last image formed most upstream in a travel direction of the continuous paper among the images formed on the continuous paper passes the fuser, stops carriage of the continuous paper and then separates the pressed bodies of revolution, and second control that separates the pressed bodies of revolution and then stops the carriage of the continuous paper, on the basis of the accepted stop position.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
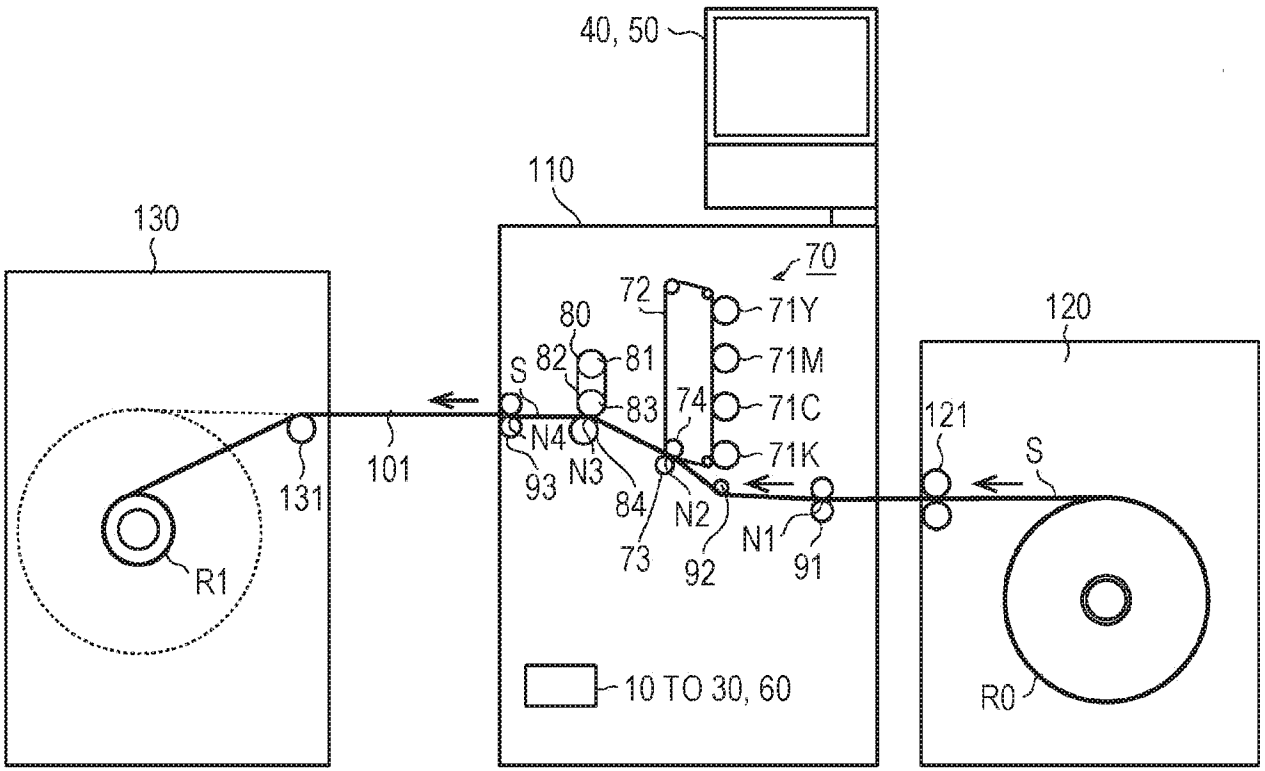
FIG. 1 is an entire configuration diagram schematically illustrating an image forming system.

Hereinafter, an image forming apparatus, an image forming system, an image forming method, and an image forming apparatus-specific program according to one or more embodiments of the present invention will be described in detail with reference to the drawings. However, the scope of the invention is not limited to the disclosed embodiments. In the drawings, the same reference numerals are assigned to the same elements, and their overlapping descriptions are omitted. Moreover, the ratios of dimensions in the drawings are exaggerated for convenience of description, and they may be different from their actual ratios.

In the following description, a position on a carriage path of an image formed on continuous paper may be simply called the "image position."

Figure 2:
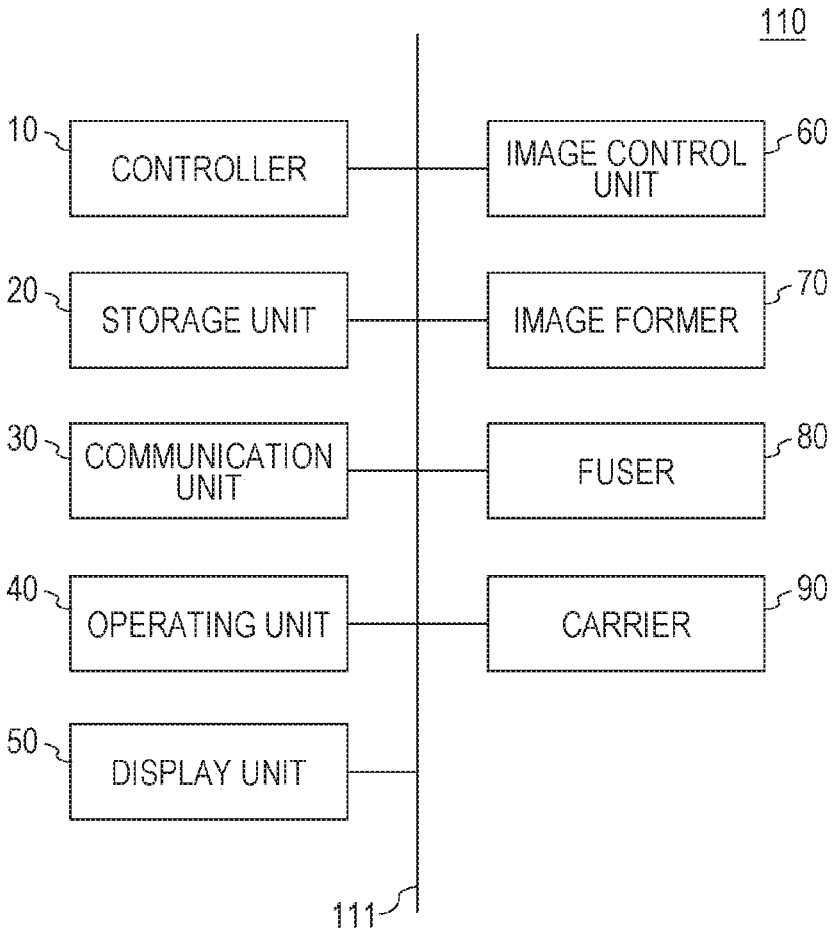
FIG. 2 is a block diagram illustrating the configuration of an image forming apparatus.

FIG. 1 is an entire configuration diagram schematically illustrating an image forming system according to an embodiment. FIG. 2 is a block diagram illustrating the configuration of an image forming apparatus.

An image forming system 100 includes an image forming apparatus 110, a paper feed apparatus 120, and a take-up apparatus 130. The image forming apparatus 110, the paper feed apparatus 120, and the take-up apparatus 130 are communicably connected to each other via a signal line. The take-up apparatus 130 is an example of a post-processing apparatus. A description is given below taking the take-up apparatus 130 as an example of the post-processing apparatus. However, the post-processing apparatus is not limited to the take-up apparatus 130. The post-processing apparatus may be, for example, a cutting apparatus that cuts continuous paper to a predetermined size.

The image forming system 100 may be configured by, for example, housing the image forming apparatus 110, the paper feed apparatus 120, and the take-up apparatus 130 in one casing to connect them via a carriage path provided in the casing. The image forming system 100 may be configured by connecting the image forming apparatus 110, the paper feed apparatus 120, and the take-up apparatus 130, which are housed respectively in different casings, via a carriage path.

The paper feed apparatus 120 houses and holds a feed roll R0 being an original roll of continuous paper S, and feeds the continuous paper S to the image forming apparatus 100 downstream in a travel direction of the continuous paper S. The image forming apparatus 110 transfers and fixes a toner image to the continuous paper S by electrophotography and accordingly forms an image on the continuous paper 5, and ejects the continuous paper S to the take-up apparatus 130. The continuous paper S on which the image has been formed is carried to the take-up apparatus 130 that is downstream in the travel direction of the continuous paper S, and taken up around a collection roll R1. The continuous paper S is carried along a carriage path 101. The travel direction is indicated by arrows in FIG. 1.

The continuous paper S includes, for example, paper-based roll paper made of plain paper, and film-based roll paper made of resin such as polypropylene or polyethylene terephthalate.

The image forming apparatus 110 is described in more detail.

The image forming apparatus 110 includes a controller 10, a storage 20, a communication unit 30, an operating unit 40, a display 50, an image controller 60, an image former 70, a fuser 80, and a earner 90. They are connected to each other via a bus 111.

The controller 10 may be configured of a Central Processing Unit (CPU). The controller 10 performs control of each component of the image forming apparatus 110 and various computation processes in accordance with a program. In other words, the controller 10 performs control and overall processing related to image formation in corporation with each component forming the image forming apparatus 110. Furthermore, the controller 10 mutually communicates with the paper feed apparatus 120 and the take-up apparatus 130, and acquires information from the paper feed apparatus 120 and the take-up apparatus 130, and also controls these apparatuses.

The operation of the controller 10 is described in detail below.

The storage 20 may be configured including a Random Access Memory (RAM), a Read Only Memory (ROM), and a Hard Disk Drive (HDD). Programs and data, are temporarily retained in the RAM as a work area of the controller 10. Various programs and various pieces of data are stored in advance in the ROM. Various programs including an operating system and programs for the controller 10 to control each component of the image forming apparatus 110, the paper feed apparatus 120, and the take-up apparatus 130 are stored in the HDD. Moreover, print jobs, image data, and other various pieces of data, which are received through the communication unit 30, are saved in the HDD. Flash memory may be used instead of the HDD.

A print job is a general name for a print command for the image forming apparatus 110, and includes print data and print settings. Print data is document data targeted for printing, and may include various pieces of data such as image data, vector data, and, text data. Specifically, print data may be Page Description Language (PDL) data, Portable Document Format (PDF) data, or Tagged Image File Format (TIFF) data. Print settings are settings related to image formation on paper, and may include various settings of, for example, the number of pages, the number of copies, the type of the continuous paper S, and the linear speed of the continuous paper S. Print setting can also be made from the operating unit 40.

The communication unit 30 is an interface for communicating between the image forming apparatus 110 and an external device. A network interface in accordance with a standard such as Ethernet (registered trademark), BATA, PCI Express, USB, or IEEE 1394 may be used as the communication unit 30. Moreover, various local connection interfaces including wireless communication interfaces such as Bluetooth (registered trademark) and IEEE 802.11 may be used as the communication unit 30.

The operating unit 40 includes a touch screen for making various settings, and various fixed keys such as a numeric keypad for setting the number of copies and the like, a start key for instructing the start of operation, a stop key for instructing the stop of operation, and a reset key for initializing various setting conditions.

The display 50 includes a touch screen for displaying various pieces of information and inputting various settings and a display lamp. It may be configured in such a manner that either the operating unit 40 or the display 50 has their overlapping functions.

The image controller 60 performs a layout process and a rasterization process on print data included in a print job received by the communication unit 30, and generates image data being image of a bitmap image.

The image former 70 forms a toner image on the surface of the continuous paper S on the basis of image data through steps of charging, exposure, development, and transfer by electrophotography.

The image former 70 includes writing units (not illustrated) corresponding respectively to basic colors, development units 71Y, 71M, 71C, and 71K ((hereinafter also collectively referred to as the "development unit 71"), an intermediate transfer belt 72, a transfer roller 73, and a counter roller 74.

Each development unit 71 has the same configuration except that the colors of toners housed therein are different. Latent images are formed on photoconductor drums of the development units 71 by exposure of the writing units in accordance with the image data. The latent images are developed by a developer to form a toner image of each color. The toner images are transferred onto the intermediate transfer belt 72 as an image carrier (primary transfer), and are superimposed sequentially to form a full-color toner image.

The intermediate transfer belt 72 is stretched on a plurality of rollers including the counter roller 74. The transfer roller 73 is biased with a predetermined pressure toward the counter roller 74 across the intermediate transfer belt 72. Consequently, a nip portion N2 is formed between the intermediate transfer belt 72 covering the counter roller 74 and the transfer roller 73. The toner image formed on the intermediate transfer belt 72 is transferred onto the continuous paper S (secondary transfer) at the nip portion N2 to form the toner image on the continuous paper S. The toner image is heated and pressed by the fuser 80 to be fixed to the surface of the paper.

In the embodiment, the image forming apparatus of the intermediate transfer belt method is illustrated by example. However, the image forming apparatus may not include the intermediate transfer belt 72 and may use the direct transfer method that transfers an image directly onto paper from the photoconductor drum. In the image forming apparatus of the direct transfer method, a plurality of photoconductor drums as image carriers, together with a plurality of transfer rollers corresponding to the photoconductor drums, is placed side by side in the travel direction, and color toner images formed respectively on the photoconductor drums are sequentially transferred and superimposed on the continuous paper S to form a full color toner image.

The fuser 80 heats and presses the toner image formed on the surface of the continuous paper S at a nip portion N3 to fix the toner image. The fuser 80 includes a heat roller 81, a fuser belt 82, an upper pressure roller 83, and a lower pressure roller 84. A plurality of heaters such as halogen lamps is placed in a hollow space in the heat roller 81.

The endless fuser belt 82 is stretched between the heat roller 81 and the upper pressure roller 83. The fuser belt 82 is controlled over temperature (heated) to a predetermined temperature by the heat roller 81 heated by the heaters.

The lower pressure roller 84 is biased with a predetermined pressure toward the upper pressure roller 83 across the fuser belt 82. Consequently, the fuser belt 82 covering the upper pressure roller 83 and the lower pressure roller 84 are pressed against each other to form the nip portion N3 between them. The toner image formed on the continuous paper S is carried to the nip portion N3 to be heated and pressed. Accordingly, the toner image is fixed to the surface of the continuous paper S. The fuser belt 82 and the lower pressure roller 84 are also hereinafter referred to as the bodies of revolution. The press between the fuser belt 82 and the lower pressure roller 84 is referred to as the "press of the bodies of revolution." Moreover, the separation between the fuser belt 82 and the lower pressure roller 84 is referred to as the "separation of the bodies of revolution."

At least one of the upper pressure roller 83 and the lower pressure roller 84 is rotationally driven by a revolution body drive motor (not illustrated). In other words, torque is applied by the revolution body drive motor to the upper pressure roller 83 and the lower pressure roller 84 to rotate the rollers, and torque is stopped to be applied to stop the rotation of the upper pressure roller 83 and the lower pressure roller 84. The rotation of the upper pressure roller 83 and the lower pressure roller 84 causes the continuous paper S to be carried through the nip portion N3 while heated and pressed. ADC motor may be used as the revolution body drive motor.

The carrier 90 includes a plurality of carriage rollers 91, 92, and 93, and drive sources such as motors (not illustrated) that drive the carriage rollers 91, 92, and 93. Stepping motors may be used as the motors. The carriage roller 93 for ejecting the continuous paper from the image forming apparatus 110 configures a paper exit roller. The motor that drives the carriage rollers 93 being the paper exit rollers is hereinafter referred to as the paper exit motor.

Both of the carriage rollers 91 are biased toward each other to form a nip portion N1, and carry the holding continuous paper S. Similarly, both of the carriage rollers 93 are biased toward each other to form a nip portion N4, and carry the holding continuous paper S. The carriage roller 92 is a driven roller, and rotates in contact with the upper side (surface) of the continuous paper S.

The carriage path 101 may be configured as a path along which the continuous paper S is carried with the rotation of the carriage rollers 91, 92, and 93. Furthermore, the carriage path 101 may also be configured as a path along which the continuous paper S is carried with the rotation of a roller 121 of the paper feed apparatus 120 and a roller 131 of the take-up apparatus 130. The carriage path 101 may have a configuration provided outside or inside the take-up apparatus 130. Moreover, the image forming apparatus 110 may have a configuration including the carriage path 101. In other words, the image forming system 100 is simply required to have a configuration including the carriage path 101.

An optical sensor (not illustrated) that detects the presence or absence of the continuous paper S and an image informed on the continuous paper S is placed along the travel direction on the carriage path 101. Consequently, among images formed on the continuous paper S, the position of an image formed most upstream in the travel direction (hereinafter referred to as the "last image") can be detected on the carriage path 101. The last image is an image that was last formed on the continuous paper S.

An optical sensor (not illustrated.) for detecting the loop amount of the continuous paper S is placed between the fuser 80 and the carriage rollers 93 on the carriage path 101. The rotation of the upper pressure roller 83 and the lower pressure roller 84, and the carriage rollers 93 is controlled on the basis of the detected loop amount. Consequently, the loop amount of the continuous paper S generated between the fuser 80 and the carriage rollers 93 is maintained at or below a predetermined threshold.

The operation of the controller 10 is described.

The controller 10 functions as an accepter that accepts a stop position of the continuous paper S (hereinafter simply referred to as the "stop position"). The stop position may be defined as a distance from the image forming apparatus 110 to stop the center (or may be the leading or trailing end) of the last image on the continuous paper S. The distance from the image forming apparatus 110 may be, for example, a distance from a paper exit port of the image forming apparatus 110. The stop position is determined in accordance with the take-up apparatus 130.

The controller 10 can accept the stop position by a user inputting the stop position as a numerical value into the operating unit 40. The controller 10 may determine the stop position on the basis of information that identifies the post-processing apparatus, the information having been transmitted from the take-up apparatus 130, to accept the stop position. At this point in time, the stop position corresponding to the take-up apparatus 130 may be used by being stored in advance in the storage 20. The information that identifies the post-processing apparatus includes, for example, a unique ID number of the take-up apparatus 130. Moreover, the controller 10 may accept the stop position by the user selecting, in the operating unit 40, any of the stop positions registered in advance according to the take-up apparatuses 130.

Figure 3:
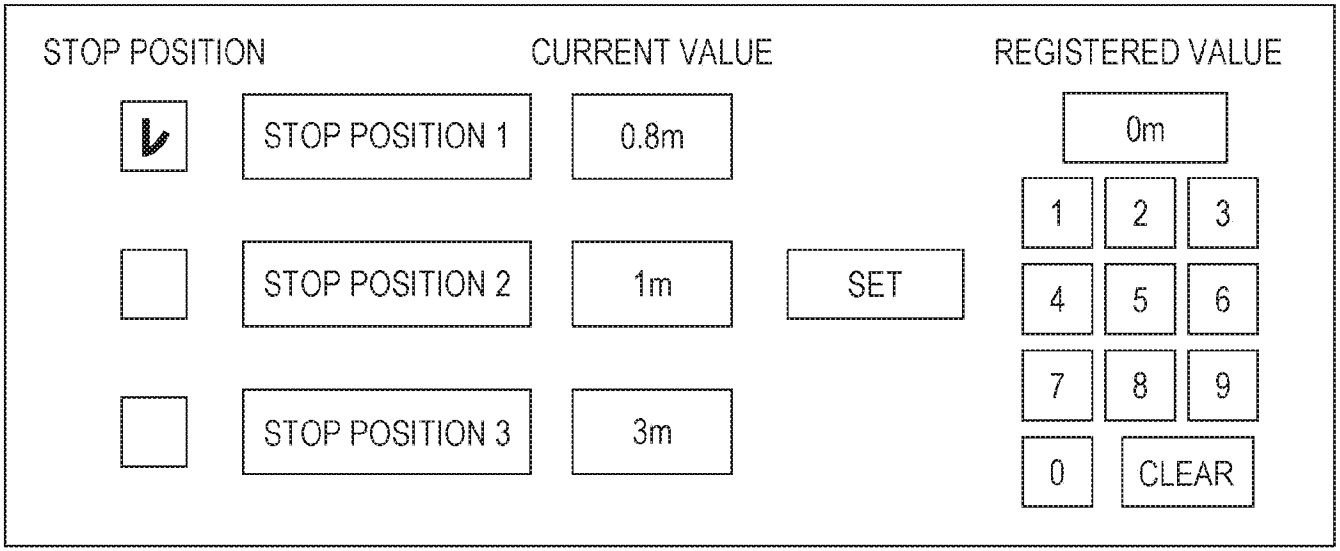
FIG. 3 is a diagram illustrating a selection screen for selecting a stop position registered according to a take-up apparatus.

FIG. 3 is a diagram illustrating a selection screen for selecting the stop position registered according to the take-up apparatus.

Three stop positions 1 to 3 registered in advance as candidates respectively according to the take-up apparatuses 130 are displayed as distances from the image forming apparatus 110 on the selection screen for selecting the stop position. Check boxes for selecting any of the three stop positions 1 to 3 are displayed. The controller 10 selects a set button to accept the stop position whose check box has been checked as the stop position in stop control. Moreover, a numeric keypad of a touch screen for numerically registering or updating the stop positions 1 to 3 as candidates for the stop position may be displayed on the selection screen. In FIG. 3, 0.8 m, 1 m, and 3 m in have been registered as the current values of the stop positions 1 to 3, respectively.

The controller 10 switches the stop control of the continuous paper S after the last image passes the fuser 80 (more specifically, the nip portion N3) between first control and second control, on the basis of the accepted, stop position. The first control is control that stops the carriage of the continuous paper S and then separates the pressed bodies of revolution of the fuser 80. The second control is control that separates the pressed bodies of revolution of the fuser 80 and then stops the carriage of the continuous paper S.

Figure 4:
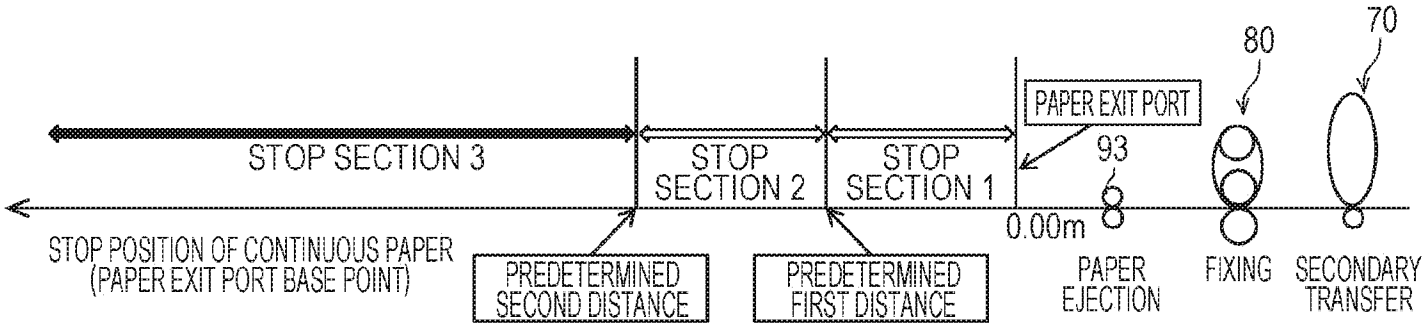
FIG. 4 is an explanatory diagram for explaining the stop position and stop control.

FIG. 4 is an explanatory diagram for explaining stop sections and the stop control.

The stop control is switched in accordance with a stop section 1, 2, or 3 where the accepted stop position is included.

The stop section 1 is a section including a stop position at less than a predetermined first distance from the image forming apparatus 110. The predetermined first distance is described below, but may be, for example, a distance of 0.97 m from the paper exit port of the image forming apparatus 110. A stop position 1 is included in the stop section 1. The stop control is performed in such a manner as to stop the last image at the stop position 1 in the stop section 1. Accordingly, it is possible to check the last image earlier and reduce the amount of waste paper. For example, a case where the last image can be checked at the stop position 1 and the continuous paper S is paper-based roll paper is conceivable as a case where the last image is stopped at the stop position 1.

The stop section 2 is a section including a stop position at equal to or greater than the predetermined first distance and equal to or less than a predetermined second distance from the image forming apparatus 110. The predetermined second distance is described below, but may be, for example, a distance of 2.28 m from the paper exit port of the image forming apparatus 110. A stop position 2 is included in the stop section 2. The stop control is performed in such a manner as to stop the last image at the stop position 2 in the stop section 2. Accordingly, it is possible to check the last image and prevent, for example, the deformation of the continuous paper caused by the heat of the fuser 80.

The stop section 3 is a section including a stop position at greater than the predetermined second distance from the image forming apparatus 110. A stop position 3 is included in the stop section 3. The stop control is performed in such a manner as to stop the last image at the stop position 3 in the stop section 3. Accordingly, it is possible to check the last image and prevent, for example, the deformation of the continuous paper caused by the heat of the fuser 80. Furthermore, it is possible to easily remove the continuous paper S at the stop position.

The controller 10 performs the first control when the accepted stop position is in the stop section 1, and performs the second control when the accepted stop position is in the stop section 2 or 3.

Figure 5:
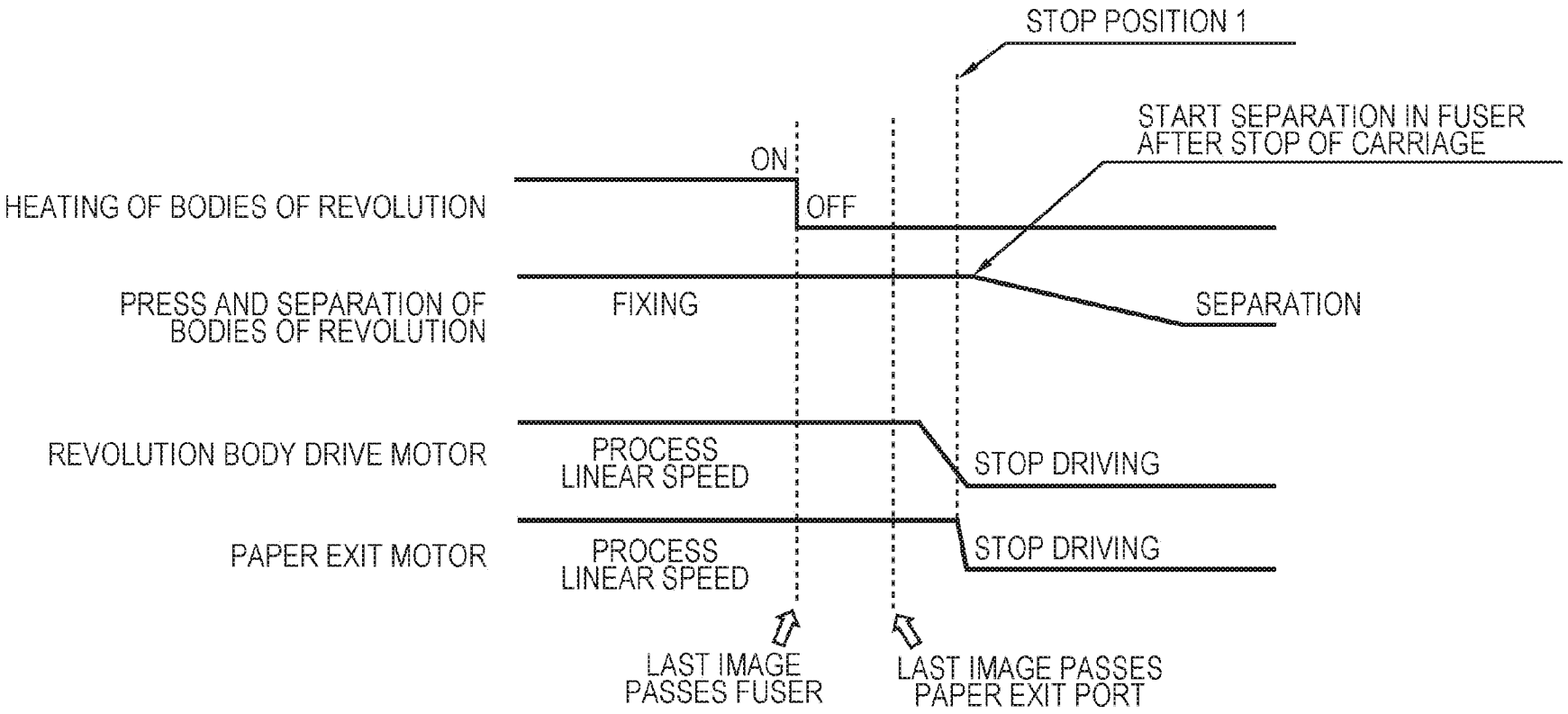
FIG. 5 is a timing chart illustrating first stop control of continuous paper in a case where an accepted stop position is a stop position 1.

FIG. 5 is a timing chart illustrating the first stop control of the continuous paper in a case where the accepted stop position is the stop position 1 (in the stop section 1). FIG. 5 illustrates control over the heating of the bodies of revolution of the fuser 80, the press and separation of the bodies of revolution (hereinafter also referred to as the "press and separation of the bodies of revolution"), the revolution body drive motor, and the paper exit motor.

In the case where the stop position 1 being the stop position at less than the predetermined first distance has been accepted, the controller 10 stops heating the bodies of revolution when the last image has passed the fuser 80. The controller 10 then performs the above-mentioned first control after the last image passes the paper exit port of the image forming apparatus 110. In other words, after the last image on the continuous paper S that is carried at the linear speed of the continuous paper S for image formation (hereinafter referred to as the "process linear speed") is stopped at the stop position 1, the bodies of revolution are separated.

In the stop control of the continuous paper S, the controller 10 adjusts the timings to stop and start the revolution body drive motor and the paper exit motor to absorb a difference in the stop time between the motors. Such adjustments are made to prevent the loop amount of the continuous paper S from becoming excessively large and the loss of synchronization of the paper exit motor due to the difference in the stop time between the revolution body drive motor and the paper exit motor. A description is given below taking, as an example, a case where the revolution body drive motor is configured of a DC motor, and the paper exit motor is configured of a stepping motor.

Figure 6:
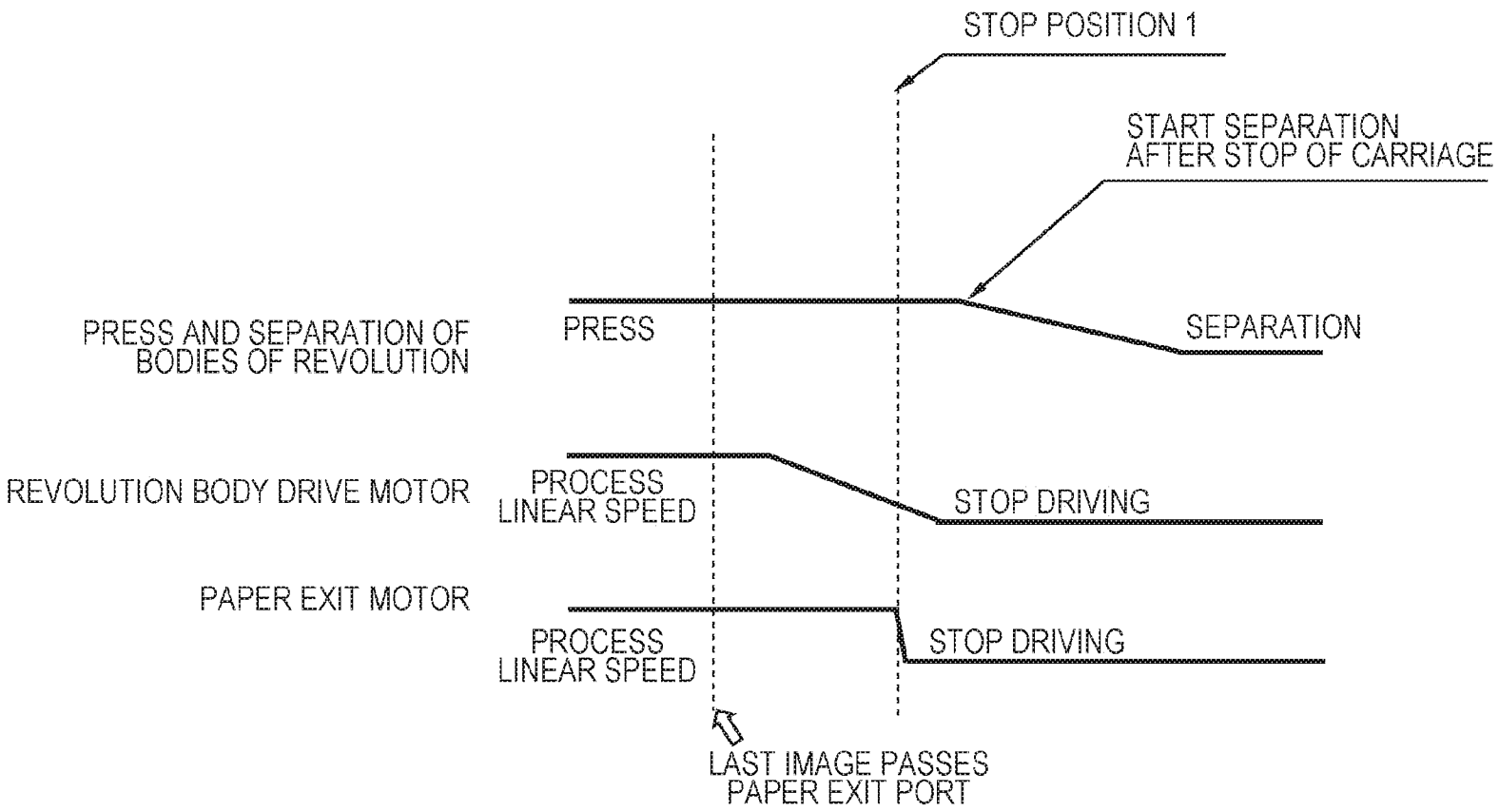
FIG. 6 is a timing chart for explaining adjustments of timings to stop and start a revolution body drive motor and a paper exit motor in the stop control of the continuous paper.

FIG. 6 is a timing chart for explaining adjustments of timings to stop and start the revolution body drive motor and the paper exit motor in the stop control of the continuous paper.

The revolution body drive motor is a DC motor, and its stop time from the start to the actual stop of the stop control is relatively long. Moreover, the influence of the inertia of the bodies of revolution further increases the stop time. On the other hand, the paper exit motor is a stepping motor; accordingly, the stop time is short. Hence, the controller 10 controls the timings to stop and start the revolution body drive motor and the paper exit motor as follows: in other words, it is configured in such a manner that a period of time from the start of the stop control over the drive and rotation of the bodies of revolution by the revolution body drive motor to the stop of the bodies of revolution includes a period of time up to the stop of the drive and rotation of the carriage rollers 93 by the paper exit motor. Consequently, the loop amount of the continuous paper generated between the bodies of revolution is maintained at or below a predetermined threshold, and also the loss of synchronization of the carriage rollers 93 is prevented.

The controller 10 can change the stop position of the continuous paper S on the basis of the type of the continuous paper S. In other words, if the continuous paper S is, for example, film-based roll paper that is more susceptible to thermal deformation than plain paper, the accepted stop position 1 can be offset to the downstream side in the travel direction of the continuous paper S. Consequently, it is possible to prevent, for example, the deformation of the continuous paper S caused by the heat of the fuser 80. Offsetting includes the addition/subtraction and multiplication of a predetermined value.

The controller 10 can adjust the stop control of the bodies of revolution for stopping the continuous paper S at the accepted stop position on the basis of at least any of the linear speed of the continuous paper S, the ambient temperature, or the ambient humidity. In other words, on the basis of the linear speed of the continuous paper S, the ambient temperature, and the ambient humidity that become factors in changing the stop position, the controller 10 controls the revolution body drive motor and the paper exit motor in such a manner as to prevent changes in the stop position caused by the factors. For example, if the linear speed of the continuous paper S is high, the force of inertia makes it difficult to stop the rotation of the carriage rollers 93 and the bodies of revolution. Accordingly, the control can be performed in such a manner that a target stop position is offset to the upstream side in the travel direction of the continuous paper S with respect to the accepted stop position. Moreover, the carriage rollers 93 and the bodies of revolution can be swelled with increasing ambient humidity. Accordingly, the control can be performed in such a manner that a target stop position is offset to the upstream side in the travel direction of the continuous paper S with respect to the accepted stop position. Values measured by a thermometer (not illustrated) and a hygrometer (not illustrated) that are installed inside or outside the image forming apparatus 110 can be used as the ambient temperature and the ambient humidity, respectively.

Figure 7:
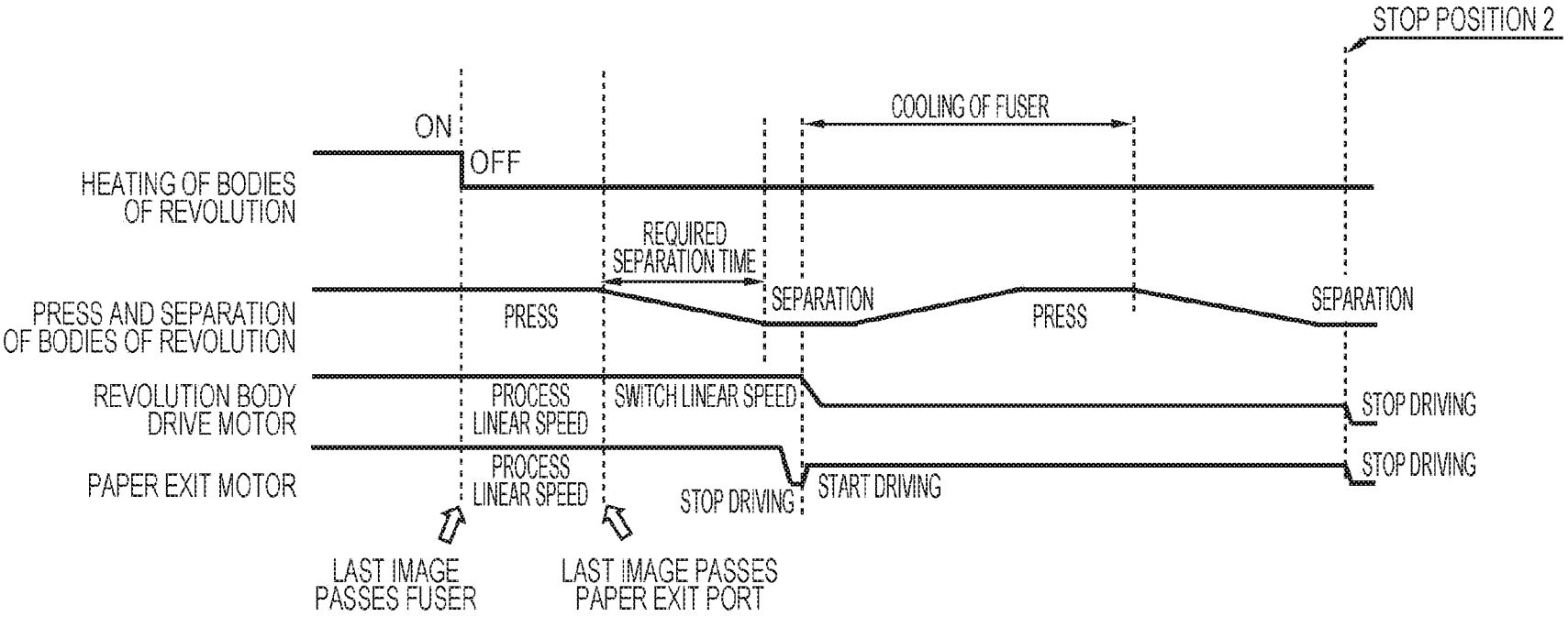
FIG. 7 is a timing chart illustrating second stop control of the continuous paper in a case where the accepted stop position is a stop position 2.

FIG. 7 is a timing chart illustrating the second stop control of the continuous paper in a case where the accepted stop position is the stop position 2 (in the stop section 2).

If the stop position 2 being the stop position at equal to or greater than the predetermined first distance has been accepted, the controller 10 stops heating the bodies of revolution when the last image has passed the fuser 80. After the last image passes the paper exit port of the image forming apparatus 110, the controller 10 performs the above-mentioned second control, in other words, after the bodies of revolution are separated over a fixed required separation time, the last image on the continuous paper S carried at the process linear speed is temporarily stopped. The controller 10 then cools the fuser 80 (more specifically, the bodies of revolution). In other words, the controller to causes the paper exit motor to resume carrying the continuous paper S at a lower speed than the process linear speed while the bodies of revolution are being separated. At this point in time, the revolution body drive motor is switched to low-speed drive corresponding to the paper exit motor. The bodies of revolution are then pressed against each other to dissipate the heat of the bodies of revolution to the continuous paper S carried at the low speed. Accordingly, the fuser 80 is cooled. After the bodies of revolution are separated, the paper exit motor drives the carriage rollers 93 to stop the last image on the continuous paper S at the stop position 2.

The predetermined first distance may be the shortest distance over which it is possible to complete the second stop control illustrated in FIG. 7, in other words, the predetermined first distance may be the shortest distance over which, after the last image passes the fuser 80, it is possible to complete the separation of the pressed bodies of revolution, the stop of the carriage of the continuous paper S, the carriage of the continuous paper S at a lower linear speed than the process linear speed, the press of the bodies of revolution, the separation of the pressed bodies of revolution, and the stop of the carriage of the continuous paper S.

Figure 8:
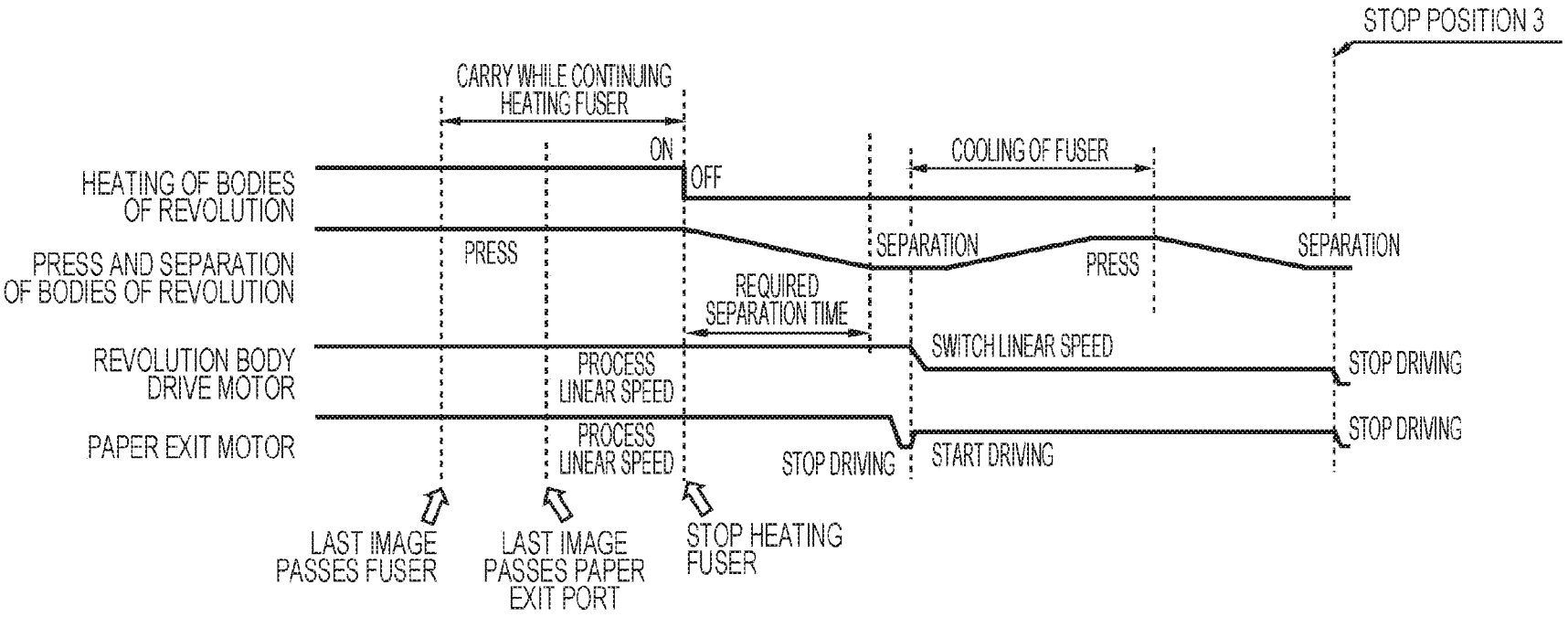
FIG. 8 is a timing chart illustrating third stop control of the continuous paper in a case where the accepted stop position is a stop position 3.

FIG. 8 is a timing chart illustrating third stop control of the continuous paper in a case where the accepted stop position is the stop position 3 (in the stop section 3).

If the stop position 3 being the stop position at greater than the predetermined second distance has been accepted, the last image is carried a predetermined distance after passing the fuser 80, and then the controller 10 stops heating the bodies of revolution. The predetermined distance may be set on the basis of, for example, the timing to start separating the bodies of revolution. In other words, the timing to stop heating the bodies of revolution may agree with the timing to start separating the bodies of revolution. In this manner, the reason that the last image is carried the predetermined distance after passing the fuser 80, and then the bodies of revolution are stopped to be heated is as follows: in other words, the stop position 3 is a position relatively away from the image forming apparatus 110; therefore, if the bodies of revolution are stopped to be heated at the earliest timing, the warm-up time for a subsequent job may be increased by over-cooling. The controller 10 starts performing the above-mentioned second control when having stopped heating the bodies of revolution. In other words, after the bodies of revolution are separated over the fixed required separation time, the last image on the continuous paper S carried at the process linear speed is temporarily stopped. The controller 10 then cools the fuser 80. In other words, the paper exit motor resumes carrying the continuous paper S at a lower speed than the process linear speed while the bodies of revolution are being separated. At this point in time, the revolution body drive motor is switched to the low-speed drive corresponding to the paper exit motor. The bodies of revolution are then pressed against each other to dissipate the heat of the bodies of revolution to the continuous paper S carried at the low speed. Accordingly, the fuser 80 is cooled. After the bodies of revolution are separated, the paper exit motor drives the carriage rollers 93 to stop the last image on the continuous paper S at the stop position 3.

The predetermined second distance may be the longest distance over which the bodies of revolution are not cooled excessively by, for example, stopping heating the bodies of revolution when the last image has passed the fuser 80.

The controller 10 can change the predetermined first distance depending on the process linear speed. Moreover, the controller 10 can change the predetermined second distance depending on the process linear speed.

Figure 9:
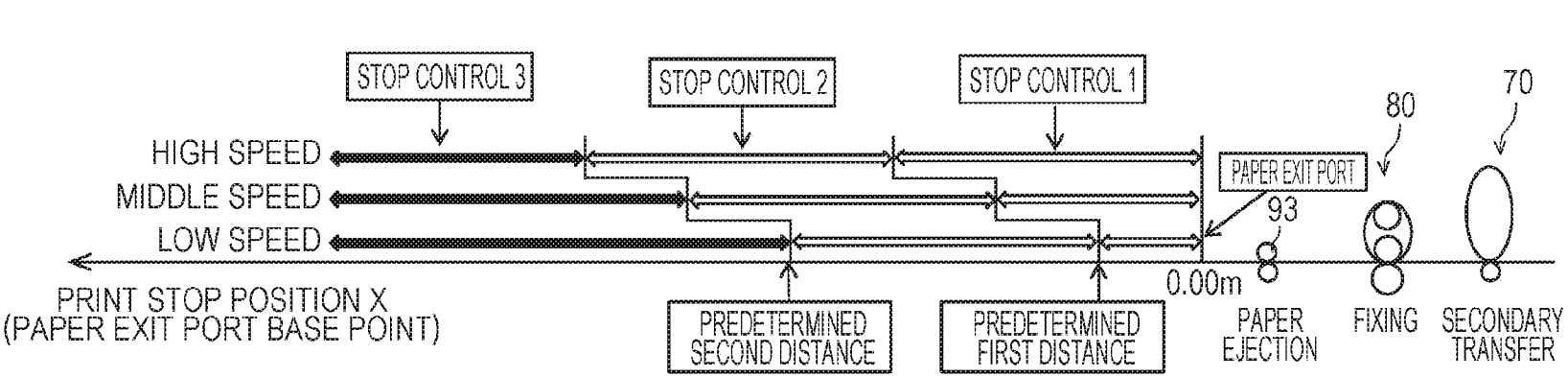
FIG. 9 is an explanatory diagram for explaining the stop position and the stop control in a case where a predetermined first distance and a predetermined second distance are changed depending on a process linear speed of the continuous paper.

FIG. 9 is an explanatory diagram for explaining the stop position and the stop control in a case where the predetermined first and second distances are changed depending on the process linear speed of the continuous paper.

As described above, the predetermined first distance may be the shortest distance over which it is possible to complete the second stop control. As illustrated in FIG. 7, in the second stop control, the continuous paper S is carried at the process linear speed during the fixed required separation time. The required separation time is constant irrespective of the process linear speed. Accordingly, the distance over which the continuous paper S is carried during the required separation time varies according to the process linear speed. Consequently, the shortest distance over which it is possible to complete the second stop control varies according to the process linear speed. Hence, the predetermined first distance can be changed depending on the process linear speed. Moreover, the predetermined first distance is changed depending on the process linear speed to also enable a change in the predetermined second distance.

As illustrated in FIG. 9, the predetermined first distance may be 0.51 m, 0.70 m, and 0.97 m corresponding to low, middle, and high process linear speeds, respectively. Moreover, the predetermined second distance may be 1.82 m, 2.01 m, and 2.28 m corresponding to the low, middle, and high process linear speeds, respectively.

Figure 10:
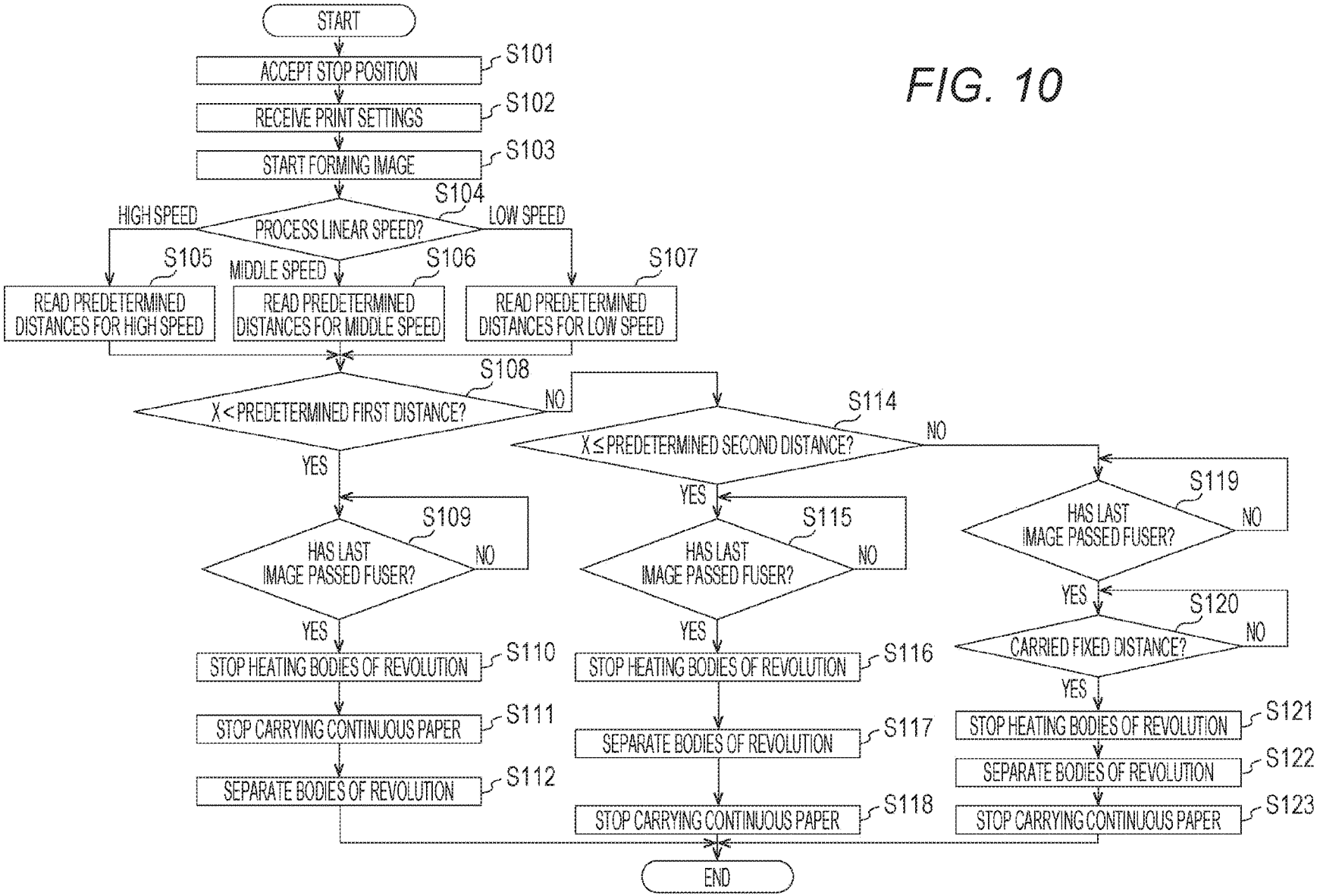
FIG. 10 is a flowchart of the operation of stopping the image forming apparatus.

FIG. 10 is a flow chart of the operation of stopping the image forming apparatus. The flow chart is executed by the controller 10 of the image forming apparatus 110 in accordance with a program.

The controller 10 accepts a stop position X of the continuous paper S (S101).

The controller 10 receives print settings included in a print job, and sets the type of the continuous paper S and the process linear speed for forming an image on the continuous paper S, on the basis of the print settings (S102).

The controller 10 starts forming an image on the continuous paper S (S103).

The controller 10 judges whether or not the process linear speed is low, middle, or high (S104), if having judged that the process linear speed is high, the controller 10 reads the predetermined first and second distances for high speed (S105). If having judged that the process linear speed is middle, the controller 10 reads the predetermined first and second distances for middle speed (S106). If having judged that the process linear speed is low, the controller 10 reads the predetermined first and second distances for low speed (S107).

If having judged that the stop position X is at less than the predetermined first distance (S108: YES), when the last image has passed the fuser 80 (S109: YES), the controller 10 stops heating the bodies of revolution of the fuser 80 (S110). The controller 10 stops carrying the continuous paper S when the last image on the continuous paper S has been carried to the stop position X (the stop position 1) (S111). The controller 10 then separates the bodies of revolution (S112).

If having judged that the stop position X is at equal to or greater than the predetermined first distance (S108: NO), the controller 10 judges whether or not the stop position X is at equal to or less than the predetermined second distance (S114). If having judged that the stop position X is at equal to or less than the predetermined second distance (S114: YES), when the last image has passed the fuser 80 (S115: YES), the controller 10 stops heating the bodies of revolution (S116). After separating the bodies of revolution (S117), the controller 10 stops carrying the continuous paper S when the last image on the continuous paper S has been carried to the stop position X (the stop position 2) (S118). As described above, the operation of cooling the fuser 80 can be executed between steps S117 and S118.

If the controller 10 has judged that the stop position X is at greater than the predetermined second distance (S114: NO), after the last image passes the fuser 80 (S119: YES) and is carried a predetermined distance (S120: YES), the controller 10 then stops heating the bodies of revolution (S121). After separating the bodies of revolution (S122), the controller 10 stops carrying the continuous paper S when the last image on the continuous paper S has been carried to the stop position X (the stop position 3) (S123).

The embodiment takes the following effects:

The first control in which, after the last image passes the fuser, the carriage of the continuous paper is stopped and then the pressed bodies of revolution are separated and the second control in which the pressed bodies of revolution are separated and then the carriage of the continuous paper is stopped are switched on the basis of the accepted stop position. Consequently, it is possible to stop the continuous paper at the stop position corresponding to the post-processing apparatus and achieve a reduction in the amount of waste paper according to the stop position and ensuring of the take-up quality.

Furthermore, when the accepted stop position is at less than the predetermined first distance from the image forming apparatus, after the last image passes the fuser, the carriage of the continuous paper is stopped. The pressed bodies of revolution are then separated. Consequently, it is possible to easily and effectively stop the continuous paper at the stop position corresponding to the post-processing apparatus, and achieve a reduction in the amount or waste paper.

Furthermore, when the accepted stop position is at equal to or greater than the predetermined first distance from the image forming apparatus, after the last image passes the fuser, the pressed bodies of revolution are separated. The carriage of the continuous paper is then stopped. Consequently, it is possible to easily and effectively stop the continuous paper at the stop position corresponding to the post-processing apparatus, and achieve a reduction in the amount of waste paper according to the stop position and ensuring of the take-up quality.

Furthermore, when the accepted stop position is at equal to or greater than the first distance from the image forming apparatus, after the last image passes the fuser, the following stop control is performed: in other words, the stop control is performed in the order of the separation of the pressed bodies of revolution, the stop of the carriage of the continuous paper, the carriage of the continuous paper at a lower carriage speed than the process linear speed, the press of the bodies of revolution, the separation of the bodies of revolution, and the stop of the carriage of the continuous paper. Consequently, it is possible to more reliably achieve ensuring of the take-up quality by cooling the bodies of revolution before stopping the continuous paper.

Furthermore, when the accepted stop position is at equal to or greater than the first distance and equal to or less than the predetermined second distance from the image forming apparatus, the bodies of revolution are stopped to be heated when the last image has passed the fuser. Consequently, it is possible to reduce the time to heat the bodies of revolution and prevent an increase in the warm-up time for a subsequent time due to over-cooling.

Furthermore, when the accepted stop position is at equal to or greater than the predetermined second distance from the image forming apparatus, the last image is carried the predetermined distance after passing the fuser. The bodies of revolution are then stopped to be heated. Consequently, it is possible to optimize the time to heat the bodies of revolution and prevent an increase in the warm-up lime for a subsequent job due to over-cooling.

Furthermore, when the accepted stop position is at greater than the second distance from the image forming apparatus, the last image is carried the predetermined distance after passing the fuser. The following stop control is then performed: in other words, the stop control is performed in the order of the separation of the pressed bodies of revolution, the stop of the carriage of the continuous paper, the carriage of the continuous paper at a lower carriage speed than the process linear speed, the press of the bodies of revolution, the separation of the bodies of revolution, and the stop of the carriage of the continuous paper. Consequently, it is possible to more reliably achieve ensuring of the take-up quality by cooling the bodies of revolution before stopping the continuous paper.

Furthermore, the stop position is accepted by a user inputting a numeric value. Consequently, it is possible to freely stop the last image at a desired stop position according to the post-processing apparatus.

Furthermore, any of the stop positions registered according to the post-processing apparatuses to be connected to the image forming apparatuses is selected. Accordingly, the stop position is accepted. Consequently, it is possible to more easily make a stop at a desired stop position according to the post-processing apparatus.

Furthermore, the stop position is determined on the basis of information that identifies the post-processing apparatus, the information being acquired from the post-processing apparatus when the post-processing apparatus is connected. The determined stop position is then accepted. Consequently, it is possible to stop the continuous paper at the stop position corresponding to the post-processing apparatus without the post-processing apparatus in mind, and achieve a reduction in the amount of waste paper according to the stop position and ensuring of the take-up quality.

Furthermore, the accepted stop position is changed on the basis of the type of continuous paper. Consequently, the stop position is optimized on the basis of the paper type. Accordingly, it is possible to effectively achieve ensuring of the take-up quality and a reduction in the amount of waste paper according to the paper type.

Furthermore, the control of at least the paper exit rollers or the bodies of revolution for stopping the continuous paper at the accepted stop position is adjusted on the basis of at least any of the linear speed of the continuous paper, the ambient temperature, or the ambient humidity. Consequently, the accuracy of stopping the continuous paper can be ensured irrespective of the linear speed of the continuous paper and the ambient conditions.

Furthermore, the registration of candidates for the stop position is accepted in advance, and also the stop position is accepted by selecting any of the registered candidates for the stop position. Consequently, the last image can be stopped more easily at a desired stop position.

When the continuous paper is stopped, a period of time from the start of the stop control over the drive and rotation of the bodies of revolution by the DC motor to the stop of the rotation of the bodies of revolution is configured to include a period of time up to the stop of the rotation of the paper exit rollers by the stepping motor. Consequently, it is possible to maintain the loop amount of the continuous paper generated between the bodies of revolution at a predetermined threshold or below, and prevent the loss of synchronization of the paper exit rollers.

Although embodiments of the image forming apparatus, the image forming system, the image forming method, and the image forming apparatus-specific program according to the present invention have been described and illustrated in detail, the disclosed embodiments are made for purposes of illustration and example only and not limitation. The scope of the present invention should be interpreted by terms of the appended claims.

For example, a part or all of processes to be executed by the program in the embodiment can be executed by being replaced with hardware such as a circuit.

What is claimed is:

1. An image forming apparatus connectable to a post-processing apparatus via a carriage path for carrying continuous paper, the image forming apparatus comprising:

a hardware processor that accepts a stop position of the continuous paper on the carriage path;

a carrier that carries the continuous paper along the carriage path;

an image former that forms an image on the continuous paper to be carried;

a fuser that heats and presses the continuous paper passing through a nip portion formed by pressing bodies of revolution against each other to fix the image formed on the continuous paper; and the hardware processor that switches between first control that, after the last image formed most upstream in a travel direction of the continuous paper among the images formed on the continuous paper passes the fuser, stops carriage of the continuous paper and then separates the pressed bodies of revolution, and second control that separates the pressed bodies of revolution and then stops the carriage of the continuous paper, on the basis of the accepted stop position.

2. The image forming apparatus according to claim 1, wherein the hardware processor executes the first control upon the stop position accepted as a stop position of the last image being at less than a predetermined first distance from the image forming apparatus.

3. The image forming apparatus according to claim 1, wherein the hardware processor executes the second control upon the stop position accepted as a stop position of the last image being at equal to or greater than a predetermined first distance from the image forming apparatus.

4. The image forming apparatus according to claim 3, wherein upon the accepted stop position being at equal to or greater than the predetermined first distance from the image forming apparatus, after the last image passes the fuser, the hardware processor controls the carrier and the fuser to stop the carriage of the continuous paper, then move the carriage of the continuous paper at a lower carriage speed than a speed for image formation, press of the bodies of revolution together, separate the pressed bodies of revolution, and then stop the carriage of the continuous paper.

5. The image forming apparatus according to claim 2, wherein upon the accepted stop position being at equal to or less than a predetermined second distance longer than the first distance from the image forming apparatus, the hardware processor stops heating the bodies of revolution when the last image has passed the fuser.

6. The image forming apparatus according to claim 5, wherein upon the accepted stop position being at greater than the second distance from the image forming apparatus, the last image is carried a predetermined distance after passing the fuser, and then the hardware processor stops heating the bodies of revolution.

7. The image forming apparatus according to claim 6, wherein upon the accepted stop position being at greater than the second distance from the image forming apparatus, the last image is carried the predetermined distance after passing the fuser, and then the hardware processor controls the carrier and the fuser to stop the carriage of the continuous paper, then move the continuous paper at a lower carriage speed than a speed for image formation, then press the bodies of revolution, then separate the pressed bodies of revolution, and then stop of the carriage of the continuous paper.

8. The image forming apparatus according to claim 1, wherein the hardware processor accepts the stop position inputted numerically by a user.

9. The image forming apparatus according to claim 1, wherein the hardware processor accepts the stop position on the basis of selection of any of the stop positions registered according to the post-processing apparatuses to be connected to the image forming apparatus.

10. The image forming apparatus according to claim 1, wherein the stop positions are registered in advance according to the post-processing apparatuses, the hardware processor determines the stop position on the basis of information that identifies the post-processing apparatus, the information being acquired from the post-processing apparatus upon connecting to the post-processing apparatus, and the hardware processor accepts the determined stop position.

11. The image forming apparatus according to claim 1, wherein the hardware processor changes the stop position accepted by the hardware processor on the basis of the type of the continuous paper.

12. The image forming apparatus according to claim 1, wherein the hardware processor adjusts control of the carrier to stop the continuous paper at the accepted stop position, on the basis of at least any of a linear speed of the continuous paper, an ambient temperature, or an ambient humidity.

13. The image forming apparatus according to claim 1, wherein the hardware processor accepts in advance registration of candidates for the stop position, and accepts the stop position on the basis of selection of any of the registered candidates for the stop position.

14. The image forming apparatus according to claim 2, wherein the first distance varies according to a linear speed of the continuous paper.

15. The image forming apparatus according to claim 5, wherein the second distance varies according to a linear speed of the continuous paper.

16. The image forming apparatus according to claim 1, wherein the carrier includes a DC motor that drives and rotates the bodies of revolution, and a paper exit roller that is provided downstream of the fuser in the travel direction of the continuous paper is rotationally driven by a stepping motor to carry the continuous paper, and upon stopping the continuous paper, the hardware processor controls the DC motor and the stepping motor in such a manner that a period of time from a start of stop control over the drive and rotation of the bodies of revolution by the DC motor to stop the rotation of the bodies of revolution includes a second period of time to stop the rotation of the paper exit roller by the stepping motor.

17. An image forming system comprising:

an image forming apparatus; and a post-processing apparatus connected to the image forming apparatus via a carriage path for carrying continuous paper, wherein the image forming apparatus includes a hardware processor that accepts a stop position of the continuous paper on the carriage path, a carrier that carries the continuous paper along the carriage path, an image former that forms an image on the continuous paper to be carried, a fuser that heats and presses the continuous paper passing through a nip portion formed by pressing bodies of revolution against each other to fix the image formed on the continuous paper, and the hardware processor that switches between first control that, after the last image formed most upstream in a travel direction of the continuous paper among the images formed on the continuous paper passes the fuser, stops carriage of the continuous paper and then separates the pressed bodies of revolution, and second control that separates the pressed bodies of revolution and then stops the carriage of the continuous paper, on the basis of the accepted stop position, and the post-processing apparatus performs post-processing on the continuous paper carried from the image forming apparatus via the carriage path.

18. An image forming method by an image forming apparatus that is connectable to a post-processing apparatus via a carriage path for carrying continuous paper, the image forming method comprising:

(a) accepting a stop position of the continuous paper on the carriage path;

(b) carrying the continuous paper along the carriage path;

(c) forming an image on the continuous paper to be carried;

(d) heating and pressing the continuous paper passing through a nip portion formed by pressing bodies of revolution against each other to fix the image formed on the continuous paper; and (e) switching between first control that, after the last image formed most upstream in a travel direction of the continuous paper among the images formed on the continuous paper passes a fuser, stops carriage of the continuous paper and then separates the pressed bodies of revolution, and second control that separates the pressed bodies of revolution and then stops the carriage of the continuous paper, on the basis of the accepted stop position.

19. A non-transitory recording medium storing a computer readable image forming apparatus-specific program for causing a computer to execute the image forming method according to claim 18, the image forming apparatus-specific program being a control program for controlling an image forming apparatus.

* * * * *